US006648538B2

(12) United States Patent
Gueret

(10) Patent No.: US 6,648,538 B2
(45) Date of Patent: Nov. 18, 2003

(54) DISPENSING DEVICE AND METHOD, AND REFILL FOR A DISPENSING DEVICE

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/915,355

(22) Filed: Jul. 27, 2001

(65) Prior Publication Data

US 2002/0025211 A1 Feb. 28, 2002

(30) Foreign Application Priority Data

Jul. 27, 2000 (FR) ..... 00 09863
Aug. 1, 2000 (FR) ..... 00 10145

(51) Int. Cl.[7] ..... A45D 33/00

(52) U.S. Cl. ..... 401/130; 401/126; 401/123; 401/175; 401/171

(58) Field of Search ..... 401/130, 126, 401/123, 124, 125, 118, 175, 171; 132/317

(56) References Cited

U.S. PATENT DOCUMENTS

| | | | | | |
|---|---|---|---|---|---|
| 2,699,885 | A | * | 1/1955 | McClure | 132/317 |
| 4,089,609 | A | * | 5/1978 | Gring et al. | 401/130 |
| 5,636,931 | A | | 6/1997 | Gueret | |
| 6,082,918 | A | | 7/2000 | Gueret | |
| 6,244,776 | B1 | * | 6/2001 | Wiley | 401/219 |

FOREIGN PATENT DOCUMENTS

| | | | |
|---|---|---|---|
| EP | 0 416 185 | | 3/1991 |
| EP | 0 931 476 | | 7/1999 |
| EP | 1 086 904 | | 3/2001 |
| FR | 360 992 | | 5/1906 |
| FR | 947 987 | | 7/1949 |
| FR | 2588457 | * | 4/1987 |
| FR | 2 718 110 | | 10/1995 |
| GB | 1 098 166 | | 1/1968 |
| GB | 1 158 412 | | 7/1969 |

OTHER PUBLICATIONS

English language Derwent Abstract of EP 1 086 904, Mar. 28, 2001.
English language Derwent Abstract of FR 2 718 110, Oct. 6, 1995.

* cited by examiner

*Primary Examiner*—David J. Walczak
(74) *Attorney, Agent, or Firm*—Finnegan Henderson Farabow Garrett & Dunner, L.L.P.

(57) ABSTRACT

A device for dispensing a product comprises a first reservoir containing the product to be dispensed, and a second reservoir in flow communication with the first reservoir via at least one passage having a cross-section that is smaller than a cross-section of the first reservoir. The device further comprises an application element configured to be accommodated in the second reservoir and a closure element configured to removably close an opening defined by an edge of the second reservoir.

An actuation mechanism is on a portion of the device other than the closure element, and is configured to move with respect to the first reservoir. A moveable member associated with the first reservoir is configured, in response to relative movement of the actuation mechanism with respect to the first reservoir, to exert pressure on the product inside the first reservoir so as to cause at least some of the product to pass via the at least one passage from the first reservoir to the second reservoir for loading at least a portion of the application element.

126 Claims, 4 Drawing Sheets

DISPENSING DEVICE AND METHOD, AND REFILL FOR A DISPENSING DEVICE

The present invention relates to a device for dispensing and applying a product, such as, for example, a cosmetic product, and also to a refill device for a dispenser. The devices and methods according to optional aspects of the invention may be particularly suitable for dispensing and/or applying products in the form of a liquid, a gel, a cream, or a paste. By way of example, the devices and methods may be for the dispensing of cosmetic and/or care products, such as make-up products, make-up removers, or hair dye products, for example, for application to the skin, hair, and/or nails.

In many fields, and especially in the field of cosmetics, certain products, for example products in the form of a milk, a cream, a paste, or a gel, are dispensed under pressure using a pump. Because of their instability in the presence of air, these products may be packaged in pump systems of the airless type. That is, they may be packaged under vacuum in containers of variable volume that decrease through use of the product. Often, use is made of a pouch with collapsible walls, a deformable-walled tube, or a bottle in which a follower piston is placed. The pump may be of a piston, diaphragm, or valve type.

To apply the product, the user may place the pumped product on one or more fingers and apply it, perhaps by rubbing it into the surface to be treated. Alternatively, the product may be applied using an applicator. The applicator may be in the form of an open-cell foam, for example.

In the case of an applicator that can be reused a number of times, for example, throughout the life of the product, it may be desirable for the applicator to be stored away from the air between uses, so that its mechanical properties, such as suppleness or absorption, are not adversely affected. Furthermore, in the case of an applicator which is not cleaned after each use, contact of product remaining on the applicator with the ambient air, or with any other element in the environment in which it is kept, carries the risk of dirtying the applicator and of adversely affecting the product. In any event, carrying such an applicator around, such as by the user in a handbag, is associated with some problems.

Finally, for certain applicators whose shape may be tailored to the profile of the surface to be treated, such as to the profile of the lips or the corner of the eye, it may be desirable for the product always to be deposited on the applicator in substantially the same way and in substantially the same quantities, so as to perform an application which is substantially repeatable from one time to the next.

Each of EP-A 0 416 185, EP-A-0 931 476, and U.S. Pat. No. 5,636,931 describes a unit having two reservoirs communicating with one another. One of the two reservoirs is intended to accommodate an applicator. A closure element is secured to a mechanism capable, in response to rotation with respect to the body of the unit, of allowing the product contained in the first compartment to be pressurized so as to force it into the compartment containing the applicator. For this purpose, the wall separating the two reservoirs is configured in the form of a piston which can move axially and/or rotate inside the unit.

One of the optional objects of the present invention is to provide a dispensing and applicator device that solves all or some of the problems discussed hereinabove with reference to the conventional devices.

Another optional object of the invention is to provide a device suitable for dispensing and applying products of high viscosity, such as those in the form of gels, creams or pastes.

A further optional object of the invention is to allow an application element that may be loaded accurately, repeatably, and predictably with product.

Yet another optional object of the invention is to provide a device that is refillable with the same or differing products.

Yet another optional object of the invention is to provide a device suitable for applying products, such as cosmetic compositions, for example, containing fillers or pigments, that avoids the problem of segregation of the fillers or pigments via the pores or cells of the applicator, a problem that is inherent to certain conventional applicator systems.

Yet another optional object of the invention is to provide a dispensing and application device that is relatively simple to use and economical to produce.

Still other optional objects will become apparent from the detailed description which follows.

According to an aspect of the invention, a device for dispensing a product comprises a first reservoir containing the product that is to be dispensed and a second reservoir in flow communication with the first reservoir via at least one passage having a cross-section that is smaller than a cross-section of the first reservoir. The device further comprises an application element configured to be accommodated in the second reservoir and a closure element configured to removably close an opening defined by an edge of the second reservoir. An actuation mechanism may be disposed on a portion of the device other than the closure element and may be configured to move with respect to the first reservoir. The device further comprises a moveable member associated with the first reservoir, the moveable member being configured, in response to the relative movement of the actuation mechanism with respect to the first reservoir, to exert pressure on the product inside the first reservoir so as to cause at least some of the product to pass via the at least one passage from the first reservoir to the second reservoir for loading at least a portion of the application element.

According to another optional aspect of the invention, a device for dispensing a product comprises a first reservoir having a first end portion and being configured to be supplied with a product to be dispensed, and a second reservoir disposed at a second end portion of the first reservoir substantially opposite to the first end portion. The device further comprises at least one passage configured to place the first reservoir and the second reservoir in flow communication with each other and an actuation mechanism configured to be removably associated with the first end portion of the first reservoir. A moveable member may be associated with the first reservoir and may be configured, in response to relative movement of the actuation mechanism with respect to the first reservoir, to cause at least some of the product to pass via the at least one passage from the first reservoir to the second reservoir. The device may further comprise an application element and at least a portion of the application element may be configured to be loaded with product passed to the second reservoir.

Yet another optional aspect includes a device for dispensing a product comprising a first reservoir configured to contain a product to be dispensed, a second reservoir, and at least one passage configured to place the first reservoir and the second reservoir in flow communication with each other. The device may further comprise a piston configured to sealably slide inside at least a portion of the first reservoir. Actuation of an actuation mechanism, accessible from an exterior of the device, may cause the piston to slide inside at least the portion of the first reservoir so as to exert pressure on the product contained in the first reservoir and cause at least some of the product to pass via the at least one passage from the first reservoir to the second reservoir. The device may further comprise an application element having at least a portion being configured to be loaded with product passed to the second reservoir.

Unlike the configurations described in U.S. Pat. No. 5,636,931, EP-A-416 185 or EP-A-931 476, the dispensing of the product with a device according to an optional aspect of the invention results from the movement of a member other than the closure element. This may facilitate the design of the closure element. This characteristic also may be advantageous when the closure element forms a handling element to hold the application element. This is because the handling element could be smaller and therefore may be easier to handle.

Communication between the first and second reservoirs may be provided via one or more passages of relatively small cross-section defined by a wall separating the first reservoir from the second reservoir. Thus, in the case of a first reservoir having a diameter on the order of approximately 20 mm, one or more holes each opening into the first and second reservoirs and having a diameter on the order of approximately 2 mm, may be made in the wall separating the two reservoirs. The number and size of the passages depends on factors such as the rheology of the product to be dispensed and on the desired delivery rate.

The wall defining the at least one passage may be substantially transverse to a longitudinal axis of the device. Optionally, the wall may be disposed at a fixed axial position on the device. The wall also may be rotably disposed, removably disposed or fixedly mounted in the device so as to prevent rotation of the wall.

The actuation mechanism may be arranged on a portion of the first reservoir located substantially opposite to the second reservoir. As a result of this arrangement, the device may be less complicated to produce. Furthermore, it may facilitate an accurate metering out of the product. In the configurations described in U.S. Pat. No. 5,636,931, EP-A-416 185, or EP-A-931 476, the actuation mechanism is arranged with respect to the first compartment on the same side as the second compartment.

According to an optional aspect, the actuation mechanism may be fixed permanently on the first compartment. Alternatively, the actuation mechanism is one of removably attached to the first reservoir or provided on a receptacle defining a removable portion of the first reservoir.

The first reservoir optionally comprises a receptacle containing the product, the receptacle being a removable portion of the first reservoir. The receptacle may be configured as a refill receptacle for the device and the actuation mechanism may be secured to the receptacle. The receptacle may be configured to pass through an opening in a first end portion of the first reservoir. As another option, the first reservoir may directly contain the product to be dispensed and the first reservoir may be configured to be refilled with product. The first reservoir may have an opening in a first end portion and the product may be filled into the first reservoir through the opening.

The at least one passage may optionally be defined by at least one of a wall separating the first reservoir and the second reservoir, a grating, a mesh, or a perforated gauze. The grating may optionally be made of metal, metal alloy or plastic, mounted fixably on an opening defined in an upper portion of the first reservoir, the openings in the grating defining numerous passages of relatively small cross-section allowing the second compartment to be fed from the first. The grating also may be removably disposed in the device. The grating may be bonded, welded, snap-fastened or otherwise suitably mounted over the opening of the first reservoir. As a further alternative, the at least one passage may be defined by a permeable (i.e., perforated) gauze, for example made of fabric or thermoplastic material. The perforated gauze may be stretched over an edge of the first reservoir delimiting the opening of the first reservoir.

Optionally, the transverse wall separating the first and second reservoirs may be obtained by molding with the other portions of the device, particularly with the body portion, which at least in part defines the first and second reservoirs.

Such a device, particularly as a result of the way in which it may be used for dispensing, may be particularly suited for the dispensing of high-viscosity products, such as various hair products, care products, or make-up products. An application element may be configured to be removably received in the second reservoir. When the application element is received in the second reservoir, it may be kept substantially sealed inside the second reservoir, which may assist to protect the application element, particularly between uses. Placing the application element in the second reservoir when exercising the actuation command may ensure that it becomes laden in a relatively repeatable, predictable, and controllable manner, particularly as regards the amount of product picked up and the position of the product relative to the application element. The application element may be bonded, welded, crimped or otherwise attached to the closure element. The closure element may be reversibly placed, such as by being screwed or snap-fastened, onto the device to close the opening in the second reservoir. The application element attached to the closure element may be configured to be removably received in the second reservoir when the closure element closes the opening defined by the second reservoir.

Unlike certain conventional systems in which, in order to reach an application surface, the composition has to pass through the applicator via the pores or cells of which it is made, according to an optional aspect of the invention, the application element may be arranged directly in contact with a face of the second reservoir into which the at least one passage opens. This allows the application element to be loaded with product substantially directly from the at least one passage. As a result of such loading, segregation of the fillers or pigments contained in the product may be substantially prevented.

The application element may comprise a closed-cell, open-cell or semi-open-cell foam, a felt, an elastomer or a frit made, for example, of either thermoplastic or ceramic, a sintered material, a felt, or an elastically compressible material. With such materials, the product may yield to the surface to be treated, either by capillarity or by a surface-tension effect upon contact with the skin, or by the expelling of the product from the pores of the application element in response to a slight deformation (by pressing) thereof on the surface to be treated. The application element also optionally may comprise several different materials such as, for example, a stack of foams of different hardnesses. It may be possible for some of the foams to be open-cell foams, the remainder being closed-cell foams.

By way of example, the application element may comprise a foamed polyether, polyester, polyurethane, NBR (natural butadiene rubber), SBR (synthetic butadiene rubber), PVC (polyvinyl chloride) or of a frit of bronze polyethylene, glass, silicone or nylon. When the application element is made of elastically compressible material, the application surface portion situated so as to face the at least one passage via which the product is conveyed may recoil elastically under the pressure of the product, so as to allow the application element to become more heavily laden on the surface and/or into the depth of the application element.

In the case of an application element made of elastically compressible material, particularly foam, the application element optionally may be dimensioned with respect to the second reservoir such that, when received inside the second reservoir, it is not significantly axially compressed. The above-mentioned recoil may become easier due to the lower resistance offered by the applicator.

According to an optional alternative, it is possible to envision that the application element is partially compressed axially inside the second reservoir so that, when the closure element to which it is secured is removed from the device to open the second reservoir, the product situated near the surface of the application element is pumped into the depth of this element in response to the decompression of the element. Furthermore, the oversizing may make it possible for the application element to become reloaded with product without it being necessary for the closure element to be screwed back completely onto the device. This embodiment may be more suitable for compositions of low viscosity.

At least part of the surface of the applicator member may be covered with flocking. The flocking may comprise rayon, cotton, viscose or nylon fibers. The flocking may contribute to creating a reserve of product immediately near the surface of the application element. Furthermore, it may confer greater gentleness on application, particularly when the application element is made of large-cell foam. The flocking may comprise a mixture of fibers of differing lengths and/or natures and/or diameters.

According to another optional embodiment, the product may be contained inside the first reservoir via a receptacle mounted removably inside a portion of the first reservoir, the intermediate receptacle constituting a refill for the device. The user, particularly when the product is a make-up product, for example for the skin, is thus able to change the color of the product at will (i.e., selectively change the color), by replacing the receptacle containing a first product with another receptacle containing a second product that may differ from the first product. For example, the products may be of differing colors or may contain differing concentrations of a particular active ingredient, such as SPF, for example. The application element may be rinsed to clean it before switching to the second product, particularly when the composition is of a different color. The first reservoir optionally may be directly filled with product and may be directly refillable, thereby eliminating the refill receptacle. In such a case, the first reservoir would require rinsing and/or cleaning prior to refilling the reservoir with a product differing from a first product that was contained in the first reservoir.

The moveable member may comprise a piston configured to sealably slide inside the first reservoir. The piston and the actuation mechanism may be coupled together via a coupling member such that movement of the actuation mechanism with respect to the first reservoir causes movement of the piston. The coupling member may optionally be selected from a threaded rod or a rack. The actuation mechanism may be rotatable or push-actuatable. Such push-actuation may comprise either axial or lateral movement. The first reservoir may be configured to directly contain the product and the piston may be configured to slide inside the first reservoir, the piston being further configured to push an amount of the product from the first reservoir to the second reservoir via the at least one passage. Optionally, the first reservoir may be configured to removably receive a receptacle configured to contain the product and the piston may be configured to slide inside the receptacle, the piston being further configured to push an amount of product from the receptacle to the second reservoir via the at least one passage when the receptacle is received in the first reservoir. The moveable member may be configured, in response to relative movement of the actuation mechanism with respect to the first reservoir, to exert pressure on the product. Exerting pressure on the product with the moveable member, via the relative movement of the actuation mechanism, may make it possible for the amount of product passing into the second reservoir to be metered out repeatedly.

As an option, the actuation mechanism may further comprise a ratchet system capable of periodically generating an audible sound so as to inform the user of the amount of product dispensed.

According to yet another optional aspect, the invention includes a refill device for use with any of the devices for dispensing a product discussed above. The refill device may comprise a receptacle configured to contain a product to be dispensed and an actuation mechanism attached to the receptacle. The refill device further may comprise at least one opening defined by the receptacle. The opening may be closed by a removable closure and may be configured to permit passage of the product from the first reservoir to the second reservoir. The removable closure optionally may be chosen from a film seal and a stopper.

As an option, the refill device may comprise a securing mechanism configured to removably secure the refill device to a portion of the first reservoir. The securing mechanism optionally may be chosen from a snap-fastener, a bayonet-fastener, screw-fastener, a friction fit between the refill device and the first reservoir, or other suitable securing mechanisms. These securing mechanisms may be designed to collaborate with complementary portions provided on the dispensing device for which the refill is intended.

In yet a further optional aspect of the invention, a refill device for use with a dispenser for a product comprises a receptacle containing a product to be dispensed by the dispenser. The receptacle may be configured to be removably received in a first portion of the dispenser defining a portion of a first reservoir. An opening defined by the receptacle may be configured to be closed by a removable closure, the opening being configured to permit passage of the product from the receptacle and into a second reservoir defined by at least a second portion of the dispenser.

The refill device may further comprise a moveable member configured to move relative to the receptacle and an actuation mechanism provided on the receptacle. The actuation mechanism may be coupled to the moveable member so that upon actuation of the actuation mechanism, the moveable member moves relative to the receptacle and exerts pressure on the product contained in the receptacle so as to cause the product contained in the receptacle to pass through the opening and to the second reservoir when the receptacle is received in the first reservoir.

Yet another optional aspect of the invention includes a method for dispensing a product comprising providing any of the dispensing devices discussed above, actuating the actuation mechanism so that the moveable member moves relative to the first reservoir and at least some product passes via the at least one passage from the first reservoir to the second reservoir. The method may further comprise loading at least a portion of the application element with the product in the second reservoir and placing at least the loaded portion of the application element in contact with a surface to apply the product to the surface. As an option, the passage through which at least some of the product passes may comprise a portion of a receptacle forming a removable portion of the first reservoir. The product may be chosen from a cosmetic product and a care product and the placing the application element in contact with a surface may comprise placing the application element in contact with at least one of hair, skin, and fingernails.

The actuating of the actuation mechanism may comprise one of pushing and rotating the actuation mechanism relative to the first reservoir. As another option, the actuating the actuation mechanism may move the movable element toward the at least one passage to push an amount of the product through the at least one passage and into the second reservoir.

The method optionally may further comprise supplying the first reservoir with the product to be dispensed. The supplying of the first reservoir may comprise directly filling the first reservoir with the product or inserting a receptacle containing the product into a portion of the first reservoir. Alternatively, the supplying may comprise refilling the first reservoir with a product to be dispensed.

The moveable member may comprise a piston configured to sealably slide inside the first reservoir and the actuating of the actuation mechanism may cause the piston to slide inside the first reservoir. As an option, the actuation mechanism may be attached to the receptacle and the moveable member may comprise a piston configured to slide sealably inside the receptacle. The actuating of the actuation mechanism may cause the piston to slide inside the receptacle.

The receptacle may define at least one opening and the inserting the receptacle in the first reservoir may comprise placing the at least one receptacle opening in flow communication with the second reservoir.

As mentioned above, the method could include providing a device. The term "providing" is used broadly herein, and refers to, but is not limited to, making available for use, giving, supplying, obtaining, getting a hold of, acquiring, purchasing, selling, distributing, possessing, making ready for use, and/or placing in a position ready for use.

The device according an optional aspect of the invention may be used for dispensing a cosmetic product, such as a make-up product, for example, or care product.

Aside from the structural and procedural arrangements set forth above, the invention could include a number of other arrangements, such as those explained hereinafter. It is to be understood that both the foregoing description and the following description are exemplary.

The accompanying drawings are incorporated in and constitute a part of this specification. The drawings illustrate optional embodiments of the invention and, together with the description, serve to explain some principles of the invention. In the drawings, FIG. 1 is a cross-sectional view of a first embodiment of a dispensing device according to the present invention;

Figure 1:
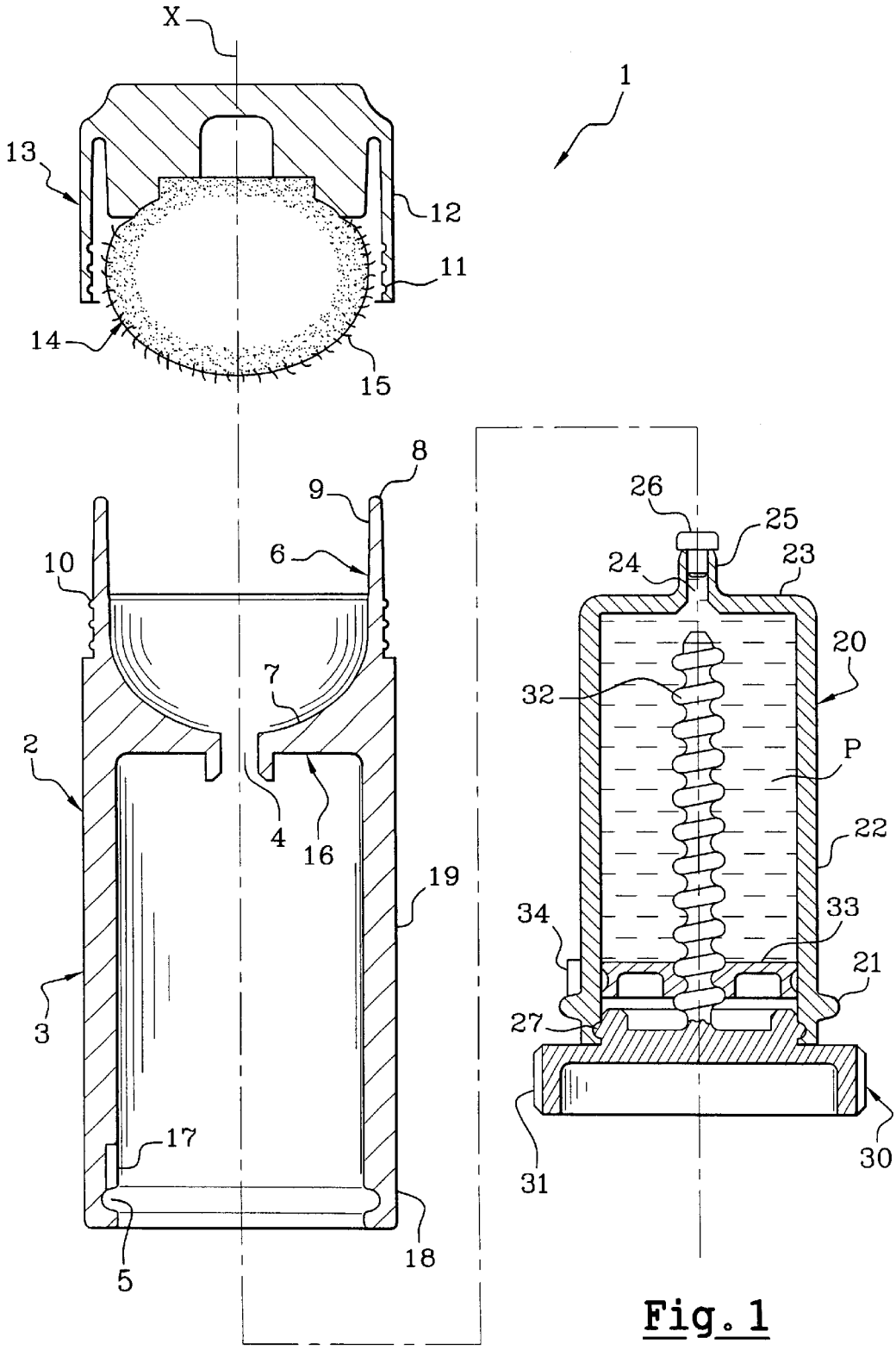

The dispensing device 1 depicted in FIG. 1 comprises a polypropylene cylindrical body 2 of longitudinal axis X. The body 2 defines a first reservoir 3, surrounded by a cylindrical skirt 19. A first end 18 of the skirt 19 is open and a second end of the skirt 19, located substantially opposite to the first, is substantially closed by a transverse wall 16. The transverse wall 16 defines a passage 4 passing through its center. The transverse wall 16 substantially separates the first reservoir 3 from a second reservoir 6. The second reservoir 6 is disposed substantially above the first reservoir 3.

A bottom 7 of the second reservoir 6 has a hemispherical shape. The passage 4 opens into the bottom 7 of the second reservoir 6. One end of the reservoir 6, substantially opposite to the bottom 7, forms a free edge 8 delimiting an opening 9. The exterior surface of the reservoir 6 may be provided with screw threading 10 configured to collaborate with corresponding screw threading 11 provided on an interior surface of a skirt 12 of a closure element in the form of a cap 13. The cap 13 is secured to an application element 14, which may be in the form of a block of an open-cell foam. The application element 14 may be shaped according to the hemispherical profile defined by the bottom 7 of the reservoir 6. The surface of the application element 14 may be covered with flocking 15, as shown. The applicator 14 may be bonded on the cap 13.

The application element 14 in FIG. 1 is dimensioned with respect to the reservoir 6 in such a way that, when the cap 13 is in the closed position, at least a portion of the application surface of the application element 14 is in contact with the bottom 7 into which the passage 4 opens. In this position, however, the application element 14 may not be appreciably compressed in the axial direction.

Near its open end 18, the interior surface of the skirt 19 defines a groove 5 intended to collaborate by snap-fastening with a corresponding bulge 21 provided on an exterior surface of a refill device 20 intended to be mounted inside the compartment 3.

The refill device 20 comprises a cylindrical body receptacle 22 defining a reservoir. One end of the reservoir is closed by an actuation mechanism 30. The actuation mechanism 30 may comprise an actuating wheel 31 mounted to rotate freely inside the refill receptacle 22 via a bulge/groove arrangement 27. The wheel 31 may be secured to a threaded rod 32 capable of axially driving a threaded piston 33, substantially incapable of rotating relative to the refill body 22. A rib/notch mechanism not depicted substantially prevents the piston from rotating inside the receptacle 22.

The end of the refill cylindrical body 22 opposite to the actuation mechanism 30 is closed by a transverse wall 23. A passageway 24 formed inside an end piece 25 passes through the traverse wall 23. The end piece 25 has an outside diameter slightly smaller than the inside diameter of the passage 4, 50 that the end can be fitted relatively tightly into the passage 4 when the refill device 20 is mounted inside the first reservoir 3. An opening of the passageway 24 delimited by the end piece 25 may be closed removably by a stopper 26.

In use, the user removes the stopper 26 and introduces the refill 20 into the compartment 3, through the open end 18, until the bulge 21 engages with the groove 5. In this position, the end piece 25 is inserted in a sealed manner inside the duct 4. The refill 20 is substantially prevented from rotating inside the first reservoir 3 by the collaboration of the rib 34 of the refill 20 with the notch 17 of the first reservoir 3.

When the cap 13 is in the closed position over the opening 9 of the second reservoir 6, the user may turn the actuation wheel 31 through approximately a half or whole turn, until a desired amount of product P passes from the refill reservoir 22 to the application element 14 contained in the second reservoir 6, via the passage 4. The product may spread out over the application element 14, particularly by capillary action, to a greater or lesser extent, and to a greater or lesser depth, depending on the rheology of the product and on the material, size, porosity and other similar characteristics of the application element 14. The cap 13 may then be unscrewed so that the application element 14 may be extracted and the product P may be applied by moving the application surface of the application element 14 over the surface to be treated.

When the refill 20 is empty, or when the user wishes to use a product of a different colour (in the case of a make-up product for example) or strength (in the case of self-tanner, for example), she removes the refill 20 that is in place and replaces it with another, containing the same or a different product. Prior to fitting the new refill, she may rinse the unit, and particularly the application element 14, so as to prevent the characteristics of the product, such as its color for example contained in the new refill from being affected by the characteristics of the product contained in the refill being replaced.

According to an alternative not illustrated, the application element 14 may be axially oversized with respect to the second reservoir 6. Thus, having applied all the product contained on the application element 14, it may be possible to reload the application element 14 without having to screw the cap 13 fully onto the device 1. Rather, the application element 14 may simply be introduced into the second reservoir 6 through the opening 9, and may pick up either the residual product resulting from the previous turning of the actuation wheel 31, or product resulting from a further turning of the actuation wheel 31 in the absence of the application element 14.

Figure 2:
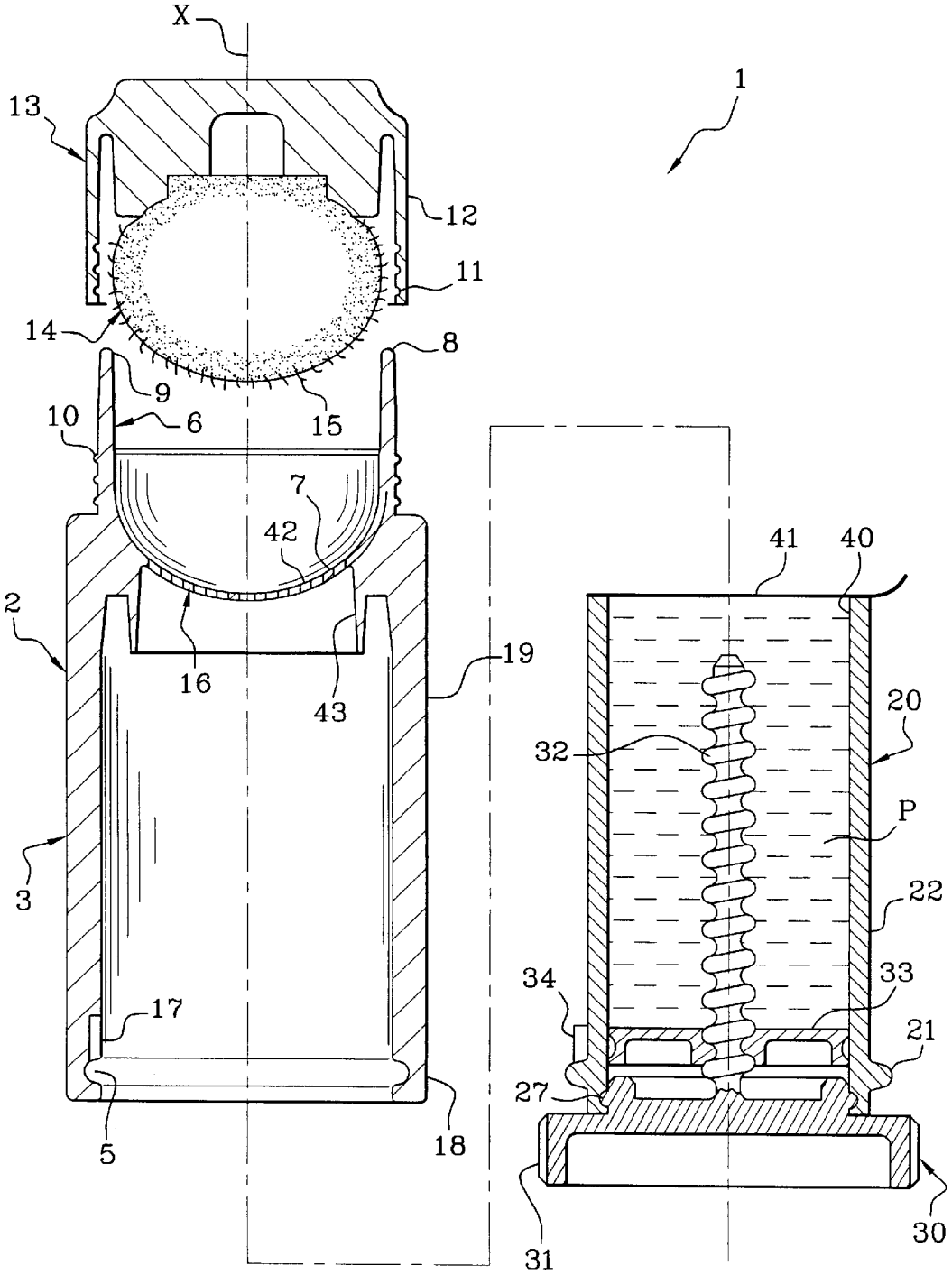
FIG. 2 is a cross-sectional view of a second optional embodiment of a dispensing device according to the present invention.

The embodiment of FIG. 2 differs from the previous embodiment in that the opening 40 of the refill 20 has a cross-section substantially similar to the cross-section of the refill body 22. The opening 40 may be closed by a removable heat-sealed film 41. The body 22 can be filled in an upside down position by sealing the opening 40 with the film 41. The wall 16 separating the first reservoir 3 from the second reservoir 6 may be in the form of a grating 42 delimited by a skirt 43 facing toward the reservoir 3. The free edge of the refill body 22 is intended to be inserted in a sealed manner.

The remainder of the device 1 is, in all other respects, substantially similar to the embodiment of FIG. 1. The similar aspects therefore will not be described again. Likewise, in use, the operation is substantially similar to the operation of the previous embodiment of FIG. 1.

On account of the presence of the grating 42, the area of which is greater than that of the passage 4 in the FIG. 1 embodiment, the embodiment of FIG. 2 may be more suited to the dispensing of products of greater viscosity. For the same viscosity, the amount of product that can be transferred from the first reservoir to the second reservoir, and thereby to the application element 14, may be greater using the device of FIG. 2.

Figure 3:
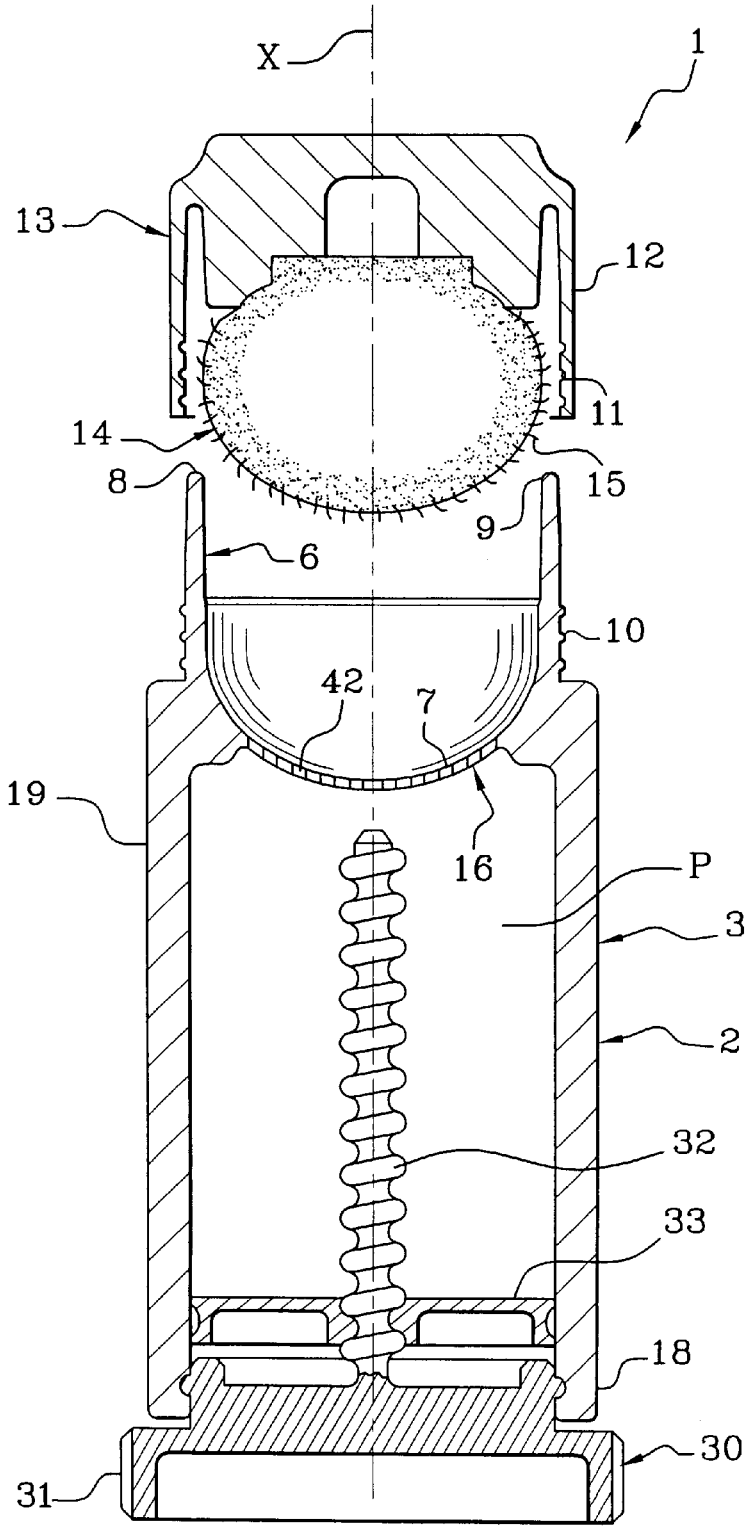
FIG. 3 is a cross-sectional view of a third optional embodiment of a dispensing device according to the present invention.

The optional embodiment of FIG. 3 differs from the embodiment of FIG. 2 in that the product P is contained directly inside the chamber 3. The open end 18 of the cylindrical body 2 may be closed directly by the actuation mechanism 30. The latter may be mounted by snap-fastening on the body 2 of the reservoir 3 through its open end 18. In use, the operation of the device according to this optional embodiment is substantially similar to the operation of the previous devices discussed with reference to FIGS. 1 and 2.

Figure 4:
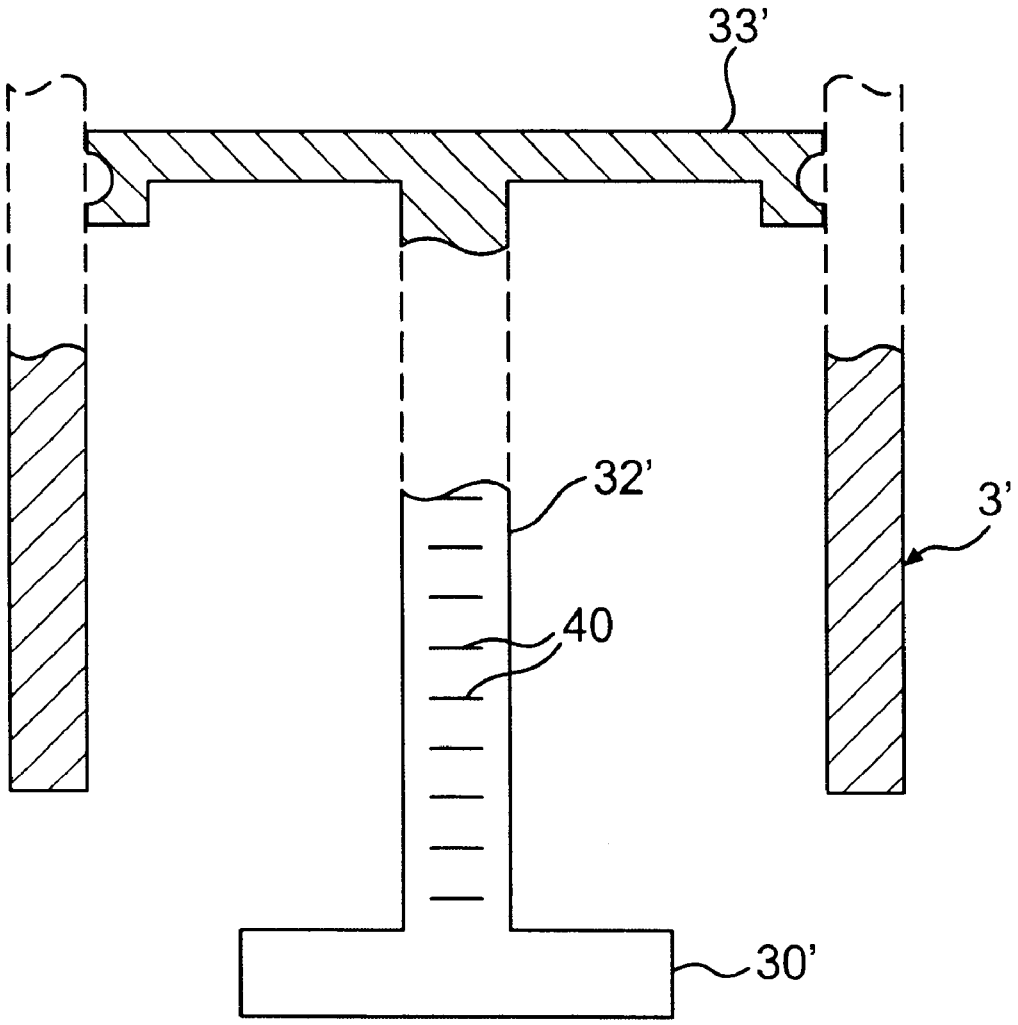
FIG. 4 is a cross-sectional view of a portion of a fourth optional embodiment of a dispensing device according to the present invention.

FIG. 4 shows a portion of another optional embodiment of a dispensing device similar to FIG. 3 except that the actuation mechanism 30' is push-actuatable and the structure coupling the mechanism 30' to a piston 33' comprises a rack 32'. For example, the rack 32' could have teeth 40 configured to engage a detent mechanism (not shown) on the first reservoir 3 to limit retraction of the piston 33' in the first reservoir 3. Alternatively, the teeth 40 could engage a rotatable actuator (not shown) having a gear engaging the teeth 40. The other portions of the device of FIG. 4 could be substantially the same as those discussed with reference to FIGS. 1–3. Although not shown, it is also contemplated that the dispensing device of FIG. 4 could be of the refill type and the push-actuatable actuation mechanism and piston could be associated with a refill configured to be inserted in the first reservoir.

The devices of the present invention may have certain advantages such that, in the case of an application element made of foam, they permit the use of a foam with relatively small cells. This may provide a gentleness to the surface during application. In addition, in the case of a product containing fillers and/or pigments, such as coloured pigments, for example, there may be substantially limited segregation thereof, which means that the colours may be imparted uniformly throughout the life of the device. This may be an advantage over devices in which the product must pass through the application element via the pores or cells of which it is made.

In the foregoing detailed description, reference was made to various optional embodiments of the invention. It is obvious that variations in sizes, shapes, materials, and other similar characteristics may be made without departing from the spirit of the invention as claimed hereinafter.

For example, the shape of the application element may differ from the shape illustrated with reference to the embodiments which have just been described. In general, the shape of the application element is chosen according to the area to be treated. For example, in the case of an applicator for the lips, use will be made, for example, of a roughly cone-shaped application element.

Furthermore, and although these aspects are not depicted, the interior surface of the second reservoir may have reliefs, for example, striations or pipings, which may communicate with the passage separating the first reservoir from the second reservoir. This may increase the amount of product with which the application element is brought into contact when inside the second reservoir. Such a feature may improve the loadability of the application element, and also may make it possible to create reserve of residual product capable, during a given use, of allowing the application element to be reloaded without having to screw it fully back onto the device.

In addition, although reference was made herein primarily to devices for dispensing cosmetic and/or care product for at least one of hair, skin, and fingernails, the device could be used with numerous other products involving dispensing and subsequent application to a surface. Such products may include, but are not limited to, shoe polishes, paints, dyes, finishers, varnishes, and other similar substances.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for dispensing a product, the device comprising:

a first reservoir containing the product to be dispensed;

a second reservoir in flow communication with the first reservoir via at least one passage having a cross-section that is smaller than a cross-section of the first reservoir;

an application element configured to be accommodated in the second reservoir;

a closure element configured to removably close an opening defined by an edge of the second reservoir, wherein the closure element forms a handling member for holding the application element;

an actuation mechanism on a portion of the device other than the closure element, the actuation mechanism being configured to move with respect to the first reservoir; and a moveable member associated with the first reservoir, the moveable member being configured, in response to relative movement of the actuation mechanism with respect to the first reservoir, to exert pressure on the product inside the first reservoir so as to cause at least some of the product to pass via the at least one passage from the first reservoir to the second reservoir for loading at least a portion of the application element.

2. The device of claim 1, wherein the actuation mechanism is arranged on a portion of the first reservoir located substantially opposite to the second reservoir.

3. The device of claim 1, wherein the actuation mechanism is one of removably attached to the first reservoir and provided on a receptacle portion of the first reservoir.

4. The device of claim 1, wherein the closure element is configured to sealably close the opening defined by the edge of the second reservoir.

5. The device of claim 1, wherein the at least one passage is formed in a wall extending substantially transverse to a longitudinal axis of the device.

6. The device of claim 5, wherein the wall is fixedly mounted in the device such that rotation of the wall is prevented.

7. The device of claim 5, wherein the wall is disposed at a fixed axial position on the device.

8. The device of claim 7, wherein the wall is removably disposed in the device.

9. The device of claim 1, wherein the first reservoir comprises a receptacle containing the product, the receptacle being a removable portion of the first reservoir.

10. The device of claim 9, wherein the receptacle is configured as a refill receptacle for the device.

11. The device of claim 10, wherein the actuation mechanism is secured to the refill receptacle.

12. The device of claim 1, wherein the first reservoir directly contains the product to be dispensed.

13. The device of claim 12, wherein the first reservoir is configured to be refilled with product.

14. The device of claim 1, wherein the at least one passage is defined by at least one of a wall separating the first reservoir and the second reservoir, a grating, a mesh, and a perforated gauze.

15. The device of claim 14, wherein the perforated gauze comprises a material chosen from fabric and a thermoplastic.

16. The device of claim 1, wherein the application element comprises a material chosen from a sintered material, a felt, an elastically compressible material, and an elastomer.

17. The device of claim 16, wherein the application element comprises an elastically compressible material chosen from a closed-cell foam, an open-cell foam, and a semi-open-cell foam.

18. The device of claim 16, wherein the application element is made of a sintered material chosen from a thermoplastic and a ceramic.

19. The device of claim 1, wherein at least a surface portion of the application element is covered with flocking.

20. The device of claim 19, wherein the flocking comprises one of rayon, cotton, viscose, and nylon.

21. The device of claim 1, wherein the moveable member comprises a piston configured to sealably slide inside the first reservoir.

22. The device of claim 21, wherein the piston and the actuation mechanism are coupled together via a coupling member such that movement of the actuation mechanism causes movement of the piston.

23. The device of claim 22, wherein the coupling member is chosen from a threaded rod and a rack.

24. The device of claim 22, wherein the actuation member is one of rotatable and push-actuatable.

25. The device of claim 21, wherein the first reservoir directly contains the product and the piston slides inside the first reservoir, the piston being configured to push an amount of the product from the first reservoir to the second reservoir via the at least one passage.

26. The device of claim 21, wherein the product is contained in a receptacle removably associated with the first reservoir and the piston slides inside the receptacle, the piston being configured to push an amount of the product from the receptacle to the second reservoir via the at least one passage when the receptacle is associated with the first reservoir.

27. A refill device for use with the device of claim 1, the refill device comprising:

a receptacle configured to contain a product to be dispensed;

the actuation mechanism attached to the receptacle; and at least one opening defined by the receptacle, the opening being closed by a removable closure, the opening being configured to permit passage of the product from the first reservoir to the second reservoir.

28. The refill device of claim 27, wherein the removable closure is chosen from a film seal and a stopper.

29. The refill device of claim 27, further comprising a securing mechanism configured to removably secure the refill device to a portion of the first reservoir.

30. The refill device of claim 29, wherein the securing mechanism is chosen from a snap-fastener, a bayonet-fastener, and a screw-fastener.

31. The refill device of claim 27, further comprising a piston configured to sealably slide inside the receptacle.

32. The refill device of claim 31, wherein the piston and the actuation mechanism are coupled together via a coupling member such that movement of the actuation mechanism causes movement of the piston.

33. The refill device of claim 32, wherein the coupling member is chosen from a threaded rod and a rack.

34. The refill device of claim 32, wherein the actuation mechanism is one of rotatable and push-actuatable.

35. A method for dispensing a product, the method comprising:

providing the device of claim 1;

actuating the actuation mechanism so that the moveable member moves relative to the first reservoir and at least some of the product passes via the at least one passage from the first reservoir to the second reservoir;

loading at least a portion of the application element with the product in the second reservoir; and placing at least the loaded portion of the application element in contact with a surface to apply the product to the surface.

36. The method of claim 35, wherein actuating the actuation mechanism comprises one of pushing and rotating the actuation mechanism relative to the first reservoir.

37. The method of claim 35, wherein actuating the actuation mechanism moves the movable element toward the at least one passage to push an amount of the product through the at least one passage and into the second reservoir.

38. The method of claim 35, further comprising supplying the first reservoir with the product to be dispensed.

39. The method of claim 38, wherein the supplying the first reservoir with the product comprises directly filling the first reservoir with the product.

40. The method of claim 39, wherein the moveable member comprises a piston configured to sealably slide inside the first reservoir, and wherein the actuating the actuation mechanism causes the piston to slide inside the first reservoir.

41. The method of claim 38, wherein the supplying the first reservoir with the product comprises inserting a receptacle containing the product into a portion of the first reservoir.

42. The method of claim 41, wherein the actuation mechanism is attached to the receptacle and the moveable member comprises a piston configured to slide sealably inside the receptacle, and further wherein the actuating the actuation mechanism causes the piston to slide inside the receptacle.

43. The method of claim 41, wherein the receptacle comprises at least one opening and the inserting the receptacle in the first reservoir comprises placing the at least one receptacle opening in flow communication with the second reservoir.

44. The method of claim 38, wherein the supplying the first reservoir with the product to be dispensed comprises refilling the first reservoir with a product to be dispensed.

45. The method of claim 35, wherein the product is chosen from a cosmetic product and a care product, and the placing at least the loaded portion of the application element in contact with a surface comprises placing the application element in contact with at least one of hair, skin, and fingernails.

46. The device of claim 1, wherein the product is chosen from a cosmetic product and a care product.

47. A device for dispensing a product, the device comprising:

a first reservoir having a first end portion, being configured to be supplied with a product to be dispensed;

a second reservoir disposed at a second end portion of the first reservoir substantially opposite to the first end portion;

at least one passage configured to place the first reservoir and the second reservoir in flow communication with each other;

an actuation mechanism configured to be removably associated with the first end portion of the first reservoir;

a moveable member associated with the first reservoir, the moveable member being configured, in response to relative movement of the actuation mechanism with respect to the first reservoir, to cause at least some of the product to pass via the at least one passage from the first reservoir to the second reservoir;

an application element, at least a portion of the application element being configured to be loaded with the product passed to the second reservoir; and a closure element configured to removably close an opening defined by the second reservoir, wherein the application element is attached to the closure element.

48. The device of claim 47, wherein the actuation mechanism is provided on a receptacle defining a removable portion of the first reservoir.

49. The device of claim 47, wherein the at least one passage is formed in a wall extending substantially transverse to a longitudinal axis of the device.

50. The device of claim 49, wherein the wall is disposed at a fixed axial position on the device.

51. The device of claim 50, wherein the wall is disposed between the first reservoir and the second reservoir.

52. The device of claim 50, wherein the wall is removably disposed in the device.

53. The device of claim 47, wherein the first reservoir comprises a removable receptacle configured to contain the product, the receptacle being configured to pass through an opening in the first end portion.

54. The device of claim 53, wherein the receptacle is configured as a refill receptacle for the device.

55. The device of claim 54, wherein the actuation mechanism is secured to the refill receptacle.

56. The device of claim 47, wherein the first reservoir is configured to directly contain the product to be dispensed.

57. The device of claim 56, wherein the first reservoir is configured to be refillable with product through an opening in the first end portion.

58. The device of claim 47, wherein the at least one passage is defined by at least one of a wall separating the first reservoir and the second reservoir, a grating, a mesh, and a perforated gauze.

59. The device of claim 58, wherein the perforated gauze comprises a material chosen from fabric and a thermoplastic.

60. The device of claim 47, wherein the application element comprises a material chosen from a sintered material, a felt, an elastically compressible material, and an elastomer.

61. The device of claim 60, wherein the application element comprises an elastically compressible material chosen from a closed-cell foam, an open-cell foam, and a semi-open-cell foam.

62. The device of claim 60, wherein the application element is made of a sintered material chosen from a thermoplastic and a ceramic.

63. The device of claim 47, wherein at least a surface portion of the application element is covered with flocking.

64. The device of claim 63, wherein the flocking comprises one of rayon, cotton, viscose, and nylon.

65. The device of claim 47, wherein the moveable member comprises a piston configured to sealably slide inside the first reservoir.

66. The device of claim 65, wherein the piston and the actuation mechanism are coupled together via a coupling member such that movement of the actuation mechanism with respect to the first reservoir causes movement of the piston.

67. The device of claim 66, wherein the coupling member is chosen from a threaded rod and a rack.

68. The device of claim 66, wherein the actuation mechanism is one of rotatable and push-actuatable.

69. The device of claim 65, wherein the first reservoir is configured to directly contain the product and the piston is configured to slide inside the first reservoir, the piston being further configured to push an amount of the product from the first reservoir to the second reservoir via the at least one passage.

70. The device of claim 65, wherein the first reservoir is configured to removably receive a receptacle configured to contain the product and the piston is configured to slide inside the receptacle, the piston being further configured to push an amount of the product from the receptacle to the second reservoir via the at least one passage when the receptacle is received in the first reservoir.

71. The device of claim 47, wherein the moveable member is configured, in response to relative movement of the actuation mechanism with respect to the first reservoir, to exert pressure on the product.

72. A refill device for use with the device of claim 47, the refill device comprising:

a receptacle configured to contain the product to be dispensed and to be removably received in a portion of the first reservoir;

the actuation mechanism attached to the receptacle; and at least one opening defined by the receptacle, the opening being configured to be closed by a removable closure and to permit passage of the product from the receptacle to the second reservoir.

73. The refill device of claim 72, further comprising the removable closure, wherein the removable closure is chosen from a film seal and a stopper.

74. The refill device of claim 72, further comprising a securing mechanism configured to removably secure the refill device to a portion of the first reservoir.

75. The refill device of claim 74, wherein the securing mechanism is chosen from a snap-fastener, a bayonet-fastener, and a screw-fastener.

76. The refill device of claim 72, further comprising the moveable member, the moveable member being in the form of a piston configured to sealably slide inside the receptacle.

77. The refill device of claim 76, wherein the piston and the actuation mechanism are coupled together via a coupling member such that movement of the actuation mechanism causes movement of the piston.

78. The refill device of claim 77, wherein the coupling member is chosen from a threaded rod and a rack.

79. The refill device of claim 77, wherein the actuation mechanism is one of rotatable and push-actuatable.

80. A method for dispensing a product, the method comprising:

providing the device of claim 47;

supplying the first reservoir with a product to be dispensed; and actuating the actuation mechanism so that the moveable member moves relative to the first reservoir and at least some of the product flows via the at least one passage from the first reservoir to the second reservoir.

81. The method of claim 80, wherein the actuating of the actuation mechanism comprises one of pushing and rotating the actuation mechanism relative to the first reservoir.

82. The method of claim 80, wherein the actuating of the actuation mechanism moves the movable element toward the at least one passage to push at least some of the product through the at least one passage.

83. The method of claim 80, wherein the supplying the first reservoir with the product comprises directly filling the first reservoir with the product.

84. The method of claim 83, wherein supplying the product in the first reservoir comprises refilling the first reservoir with a product to be dispensed.

85. The method of claim 83, wherein the moveable member comprises a piston configured to sealably slide inside the first reservoir, and wherein the actuating of the actuation mechanism causes the piston to slide inside the first reservoir and push an amount of product from the first reservoir to the second reservoir via the at least one passage.

86. The method of claim 80, wherein the supplying the first reservoir with the product comprises inserting a receptacle containing the product into a portion of the first reservoir.

87. The method of claim 86, wherein the actuation mechanism is attached to the receptacle and the moveable member comprises a piston configured to sealably slide inside the receptacle, and further wherein the actuating of the actuation mechanism causes the piston to slide inside the receptacle and to push an amount of the product through the at least one passage and into the second reservoir.

88. The method of claim 86, wherein the receptacle comprises at least one opening and the inserting of the receptacle in a portion of the first reservoir comprises placing the at least one receptacle opening in flow communication with the second reservoir.

89. The method of claim 80, wherein the product is chosen from a cosmetic product and a care product.

90. The method of claim 89, further comprising loading at least a portion of the application element with the product passed to the second reservoir and placing at least the loaded portion of the application element in contact with at least one of hair, skin, and fingernails.

91. The method of claim 80, further comprising loading at least a portion of the application element with the product passed to the second reservoir and placing at least the loaded portion of the application element in contact with a surface to apply the product.

92. The device of claim 47, wherein the closure element is configured to sealably close the opening defined by the second reservoir.

93. The device of claim 47, wherein the application element is configured to be removably received in the second reservoir when the closure element closes the opening defined by the second reservoir.

94. The device of claim 47, wherein the product is chosen from a cosmetic product and a care product.

95. A device for dispensing a product, the device comprising:

a first reservoir configured to contain a product to be dispensed;

a second reservoir;

at least one passage configured to place the first reservoir and the second reservoir in flow communication with each other;

a piston configured to sealably slide inside at least a portion of the first reservoir;

an actuation mechanism accessible from an exterior of the device, wherein actuation of the actuation mechanism causes the piston to slide inside at least a portion of the first reservoir so as to exert pressure on the product contained in the first reservoir and cause at least some of the product to pass via the at least one passage from the first reservoir to the second reservoir;

an application element, at least a portion of the application element being configured to be loaded with the product passed to the second reservoir; and a closure element configured to removably close an opening defined by the second reservoir, wherein the application element is attached to the closure element.

96. The device of claim 95, wherein the first reservoir comprises a receptacle configured to be removably associated with the device, the receptacle being configured to contain the product to be dispensed.

97. The device of claim 96, wherein the piston is configured to sealably slide inside the receptacle.

98. The device of claim 95, wherein the first reservoir directly contains the product to be dispensed.

99. The device of claim 95, wherein the piston is configured to slide inside at least the portion of the first reservoir and move toward the at least one passage.

100. The device of claim 95, wherein the actuation mechanism is removably associated with the first reservoir.

101. The device of claim 95, wherein the piston and the actuation mechanism are coupled together via a coupling member such that movement of the actuation mechanism with respect to the first reservoir causes movement of the piston.

102. The device of claim 101, wherein the coupling member is chosen from a threaded rod and a rack.

103. The device of claim 95, wherein the actuation member is one of rotatable and push-actuatable.

104. The device of claim 95, wherein the closure element is configured to sealably close the opening defined by the second reservoir.

105. The device of claim 95, wherein the application element is configured to be removably received in the second reservoir when the closure element closes the opening defined by the second reservoir.

106. A method for dispensing a product, the method comprising:

providing the device of claim 95;

supplying the first reservoir with a product to be dispensed; and actuating the actuation mechanism so that the piston slides inside at least the portion of the first reservoir and at least some of the product flows via the at least one passage from the first reservoir to the second reservoir.

107. The method of claim 106, wherein the actuating of the actuation mechanism comprises one of pushing and rotating the actuation mechanism relative to the first reservoir.

108. The method of claim 106, wherein the actuating of the actuation mechanism moves the piston toward the at least one passage to push an amount of the product through the at least one passage and into the second reservoir.

109. The method of claim 108, wherein the supplying the first reservoir with the product comprises directly filling the first reservoir with the product.

110. The method of claim 108, wherein the supplying the first reservoir with the product comprises inserting a receptacle containing the product into a portion of the first reservoir, the piston being slidably disposed inside the receptacle.

111. The method of claim 110, wherein the actuation mechanism is attached to the receptacle.

112. The method of claim 110, wherein the receptacle comprises at least one opening and the inserting of the receptacle in the first reservoir comprises placing the at least one receptacle opening in flow communication with the second reservoir.

113. The method of claim 108, wherein providing the product in the first reservoir comprises refilling the first reservoir with a product to be dispensed.

114. The method of claim 106, wherein the product is chosen from a cosmetic product and a care product.

115. The method of claim 114, further comprising loading at least the portion of the application element with the product passed to the second reservoir and placing at least the loaded portion of the application element in contact with at least one of hair, skin, and fingernails.

116. The method of claim 106, further comprising loading at least the portion of the application element with the product passed to the second reservoir and placing at least the loaded portion of the application element in contact with a surface to apply the product.

117. The device of claim 95, wherein the product is chosen from a cosmetic product and a care product.

118. A refill device for use with a dispenser for a product, the refill device comprising:

a receptacle containing a product to be dispensed by the dispenser, the receptacle being configured to be removably received in a first portion of the dispenser defining a portion of a first reservoir;

an opening defined by the receptacle, the opening being configured to permit passage of the product from the receptacle into a second reservoir defined by at least a second portion of the dispenser;

a removable closure configured to close the opening prior to being received in the dispenser;

a moveable member configured to move relative to the receptacle; and an actuation mechanism provided on the receptacle, wherein the actuation mechanism is coupled to the moveable member so that upon actuation of the actuation mechanism, the moveable member moves relative to the receptacle and exerts pressure on the product contained in the receptacle so as to cause the product contained in the receptacle to pass through the opening and to the second reservoir when the receptacle is received in the first reservoir.

119. The refill device of claim 118, wherein the removable closure is chosen from a film seal and a stopper.

120. The refill device of claim 118, further comprising a securing mechanism configured to removably secure the refill device to the first portion of the dispenser.

121. The refill device of claim 120, wherein the securing mechanism is chosen from a snap-fastener, a bayonet-fastener, and a screw-fastener.

122. The refill device of claim 118, wherein the moveable member comprises a piston configured to sealably slide inside the receptacle.

123. The refill device of claim 122, wherein the piston and the actuation mechanism are coupled together via a coupling member such that movement of the actuation mechanism causes movement of the piston.

124. The refill device of claim 123, wherein the coupling member is chosen from a threaded rod and a rack.

125. The refill device of claim 118, wherein the actuation mechanism is one of rotatable and push-actuatable.

126. The refill device of claim 118, wherein the product contained in the receptacle is chosen from a cosmetic product and a care product.

* * * * *

UNITED STATES PATENT AND TRADEMARK OFFICE

CERTIFICATE OF CORRECTION

PATENT NO. : 6,648,538 B2
DATED : November 18, 2003
INVENTOR(S) : Jean-Louis H. Gueret It is certified that error appears in the above-identified patent and that said Letters Patent is hereby corrected as shown below:

Column 13,
Line 38, "portion, being" should read -- portion, the first reservoir being --.

Signed and Sealed this

Second Day of March, 2004

JON W. DUDAS
*Acting Director of the United States Patent and Trademark Office*